United States Patent [19]

Brunsing et al.

[11] Patent Number: 4,671,367

[45] Date of Patent: Jun. 9, 1987

[54] POLE HOLE DIGGER WITH PERCUSSIVE CORE DRILLING

[75] Inventors: Thomas P. Brunsing, Santa Rosa, Calif.; Allan T. Fisk, Needham, Mass.; Joseph Spector, Natick, Mass.; Thomas Tallone, Dedham, Mass.

[73] Assignee: Electric Power Research Institute, Inc., Palo Alto, Calif.

[21] Appl. No.: 805,499

[22] Filed: Dec. 5, 1985

[51] Int. Cl.[4] ..... E21B 25/10

[52] U.S. Cl. ..... 175/58; 175/96; 175/253; 299/15

[58] Field of Search ..... 175/20, 58, 92, 95, 175/96, 107, 113, 246, 249, 253, 258, 293, 296, 220; 173/32, 50, 73, 74, 145; 299/15, 62

[56] References Cited

U.S. PATENT DOCUMENTS

| | | | |
|---|---|---|---|
| 1,717,271 | 6/1929 | Simmons . | |
| 1,867,721 | 7/1932 | Wellensiek . | |
| 1,896,106 | 2/1933 | Simmons . | |
| 1,987,853 | 1/1935 | Howard et al. | 255/72 |
| 2,030,015 | 2/1936 | McCurdy | 255/72 |
| 2,123,453 | 7/1938 | Catland et al. | 255/72 |
| 2,951,683 | 9/1960 | Tilden | 255/72 |
| 2,979,318 | 4/1961 | Haspert et al. | 262/7 |
| 3,597,929 | 8/1971 | Bodine | 175/20 |
| 3,948,330 | 4/1976 | Langford, Jr. | 175/213 |
| 3,968,845 | 7/1976 | Chaffin | 175/60 |
| 4,013,319 | 3/1977 | Wise | 175/96 |
| 4,148,366 | 4/1979 | Beckstrom et al. | 173/50 |

FOREIGN PATENT DOCUMENTS

| | | | |
|---|---|---|---|
| 1583078 | 4/1970 | Fed. Rep. of Germany | 299/15 |
| 3114612 | 7/1982 | Fed. Rep. of Germany | 175/296 |
| 0794221 | 1/1981 | U.S.S.R. | 175/249 |

*Primary Examiner*—James A. Leppink
*Assistant Examiner*—Terry Lee Melius
*Attorney, Agent, or Firm*—Flehr, Hohbach, Test, Albritton & Herbert

[57] ABSTRACT

A drilling attachment for a utility truck designed for digging pole holes for ordinary utility and telephone poles is disclosed herein. The attachment is intended to replace the auger portion of a conventional auger digger when it is necessary to drill through rock or other hard materials. The excavating method contemplated employs a three step process. First, a deep kerf is cut into the rock by a plurality of drill bits that are independently driven in a rotary/percussive manner while being rotated about the circumference of the kerf. The dust and rock fragments generated by this process are removed from the kerf by an air flushing/vacuum system, that also serves to cool the drill bits. Second, a hydraulic piston is inserted into the kerf and expanded, thereby applying a lateral force to the base of the resultant core causing it to break away from the surrounding rock. Finally an expandable plug is inserted into a pilot hole located at the center of the core. The plug is then engaged and lifted, thereby removing the core.

4 Claims, 12 Drawing Figures

POLE HOLE DIGGER WITH PERCUSSIVE CORE DRILLING

The present invention relates generally to an improved method of and apparatus for digging holes and more particularly to a method of and apparatus for digging pole holes in rock or other hard material for ordinary telephone and utility poles. Still more specifically, the present invention relates to a method of and an apparatus for excavating hard material such as rock utilizing a plurality of high frequency rotary-percussive driven bits to cut a deep kerf into the rock. The resultant core is then broken and removed, thereby leaving the desired hole.

Utility poles are typically erected by insertion into a hole intended to receive the bottom of the poles. A suitable hole normally must be five to six feet deep to adequately support the utility pole. Such holes are generally drilled by conventional auger digger trucks which have a boom attached to the back of the truck. The boom in turn is attached to an auger through a torque head which rotates the auger allowing it to dig (see FIG. 1). A major disadvantage of such an arrangement is that when a hole must be drilled into rock or any other hard material, the use of a conventional digger truck head, does not provide sufficient downward force to penetrate the rock.

Other industries have faced similar obstacles when confronted with drilling through rock and have addressed the problem in a variety of different ways. For example, in U.S. Pat. No. 2,979,318 (HASPERT et al) there is taught a kerf and cut method of carving tunnels. A rotary drilling motion is used to cut a kerf about a core of material that is sought to be removed. After a core of desirable length has been exposed, it is severed from the surrounding earth material and removed. Such an approach is an inefficient method of drilling holes for utility poles since it would require the application of a substantial downward force in defiance of the standard auger digger truck's capabilities.

In other applications rotary drills with percussive or pounding movements have been proposed for cutting core barrels in well-drilling apparatus. See, for example, U.S. Pat. Nos. 1,717,271 and 1,896,105 to SIMMONS. However such devices also have several drawbacks. SIMMONS' systems contemplate crushing all of the material in the drill's path. This is extremely inefficient when drilling through rock. Additionally, such devices cause all of the drill scraps to be packed into the core barrel which necessitates having a core barrel that is emptied. This is undesirable since drilling must stop while the core barrel is being emptied.

It is therefore an objective of the present invention to provide another approach to drilling holes through rock, which approach does not have the disadvantages discussed above.

A further object of the present invention is to teach a method of efficiently cutting through rock or other hard materials.

A more specific object of the present invention is to provide a means for using a combination of both rotary and percussive motion and rotational motion (e.g. rotation about a spaced axis) to drive a drill bit when cutting through rock or other hard materials.

Another specific object of the present invention is to independently vary the percussive and rotary motion and rotational movement of the last-mentioned drill bits depending upon the type of rock or soil being drilled into in order to maximize cutting efficiency.

A still further object of the present invention is to provide an attachment for use with an auger digger truck designed for drilling pole holes for conventional utility and telephone poles that can be used in place of a conventional auger digger when it is necessary to drill through rock or other hard materials.

Yet another object of the present invention is to provide a means of effectively removing cutting scraps from the drilling face of a rock drill bit.

An additional object of the present invention is to provide a means of effectively cooling the bits of a drill driven in a percussive-rotational manner.

Further objects and advantages of the invention will become apparent from the accompanying drawings and the following description read in conjunction with the claims.

These and other objects are accomplished with the present invention by a core drilling assembly that is adapted for attachment to a torque head capable of providing rotary motion. The core drilling apparatus cuts a circular kerf several feet into the ground. A hydraulic piston positioned within a section of the kerf is then expanded causing the core to be severed from the surrounding rock. The core is then removed forming the desired hole. In accordance with the present invention, the core drilling apparatus has two drill bits that are mounted about the bottom of a cylindrical coring sleeve which is rotated about its longitudinal axis. The drill bits are independently driven in a rotary percussive manner as they are rotated about the circular orbit defined by the coring sleeve. The drill bits so driven cut a deep kerf into the rock they attack.

Preferably, a separate hydraulic rock drill is provided to drive each drill bit. The rock drills are mounted to an assembly between the core sleeve and the torque head to the coring sleeve, which assembly rotates within the core sleeve. They are connected to their associated drill bits via strike bars that are housed within the walls of the coring sleeve. A rotary union mounted on the shaft of the drilling assembly accommodates circulation of hydraulic fluid between an external source and the rock drills.

The core drilling apparatus preferably also has an air flushing/vacuum system that introduces compressed air through the rotary union and feeds it to each drill bit. Each bit has an interior passage with an opening near the working face of the drill. Air from the air flushing-/vacuum system is passed through the interior passages and out the openings of each drill bit in a manner that causes a jet of air to be focused on the portion of the rock that the drill bit is then working on. The impacting airstream causes dust and debris created by the drilling action to become suspended in the air which is then sucked from the vicinity of the drill bits by means of vacuum and expelled at a location remote from the hole being dug.

The advantages of the technique just described are numerous. First, since only a circular kerf is drilled into the rock, less rock must actually be devoured by the drill bits which allows the drilling to proceed at a much faster rate as compared to a drill having the same power that must break all of the rock when drilling a hole of the same diameter. At the same time, driving the drill bits in the rotary-percussive manner contemplated by the present invention further adds to the drilling efficiency. Still another advantage is that the dust and debris generated by the drilling action are removed by the air flushing/vacuum system thereby eliminating the need to empty the core barrel while drilling is in progress. The air flushing/vacuum system has the added benefit of cooling the drill bits which also serves to enhance drilling efficiency and prolong the life of the drill bits. Still another advantage is that the present technique can be used with a standard auger digger truck that normally drives a conventional auger.

The following is a brief description of the drawings.

Figure 2:
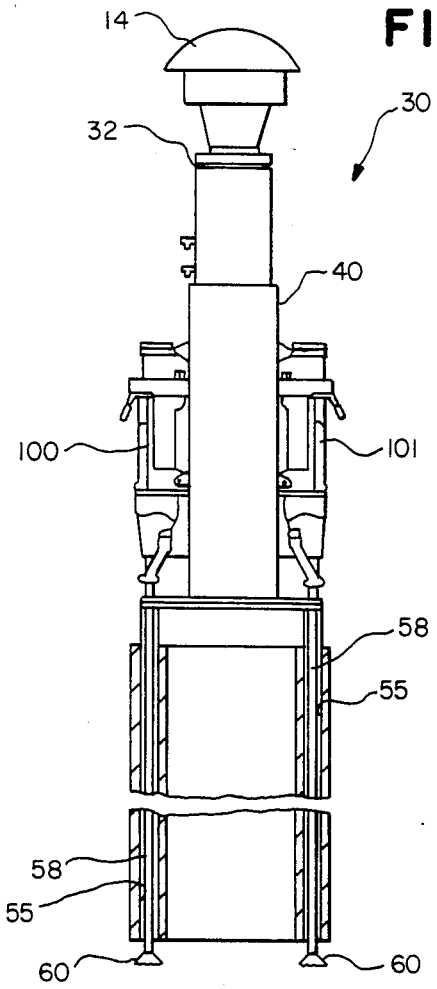
FIG. 2 is an elevational view of a percussive kerf cutting apparatus designed in accordance with the present invention.
Figure 6:
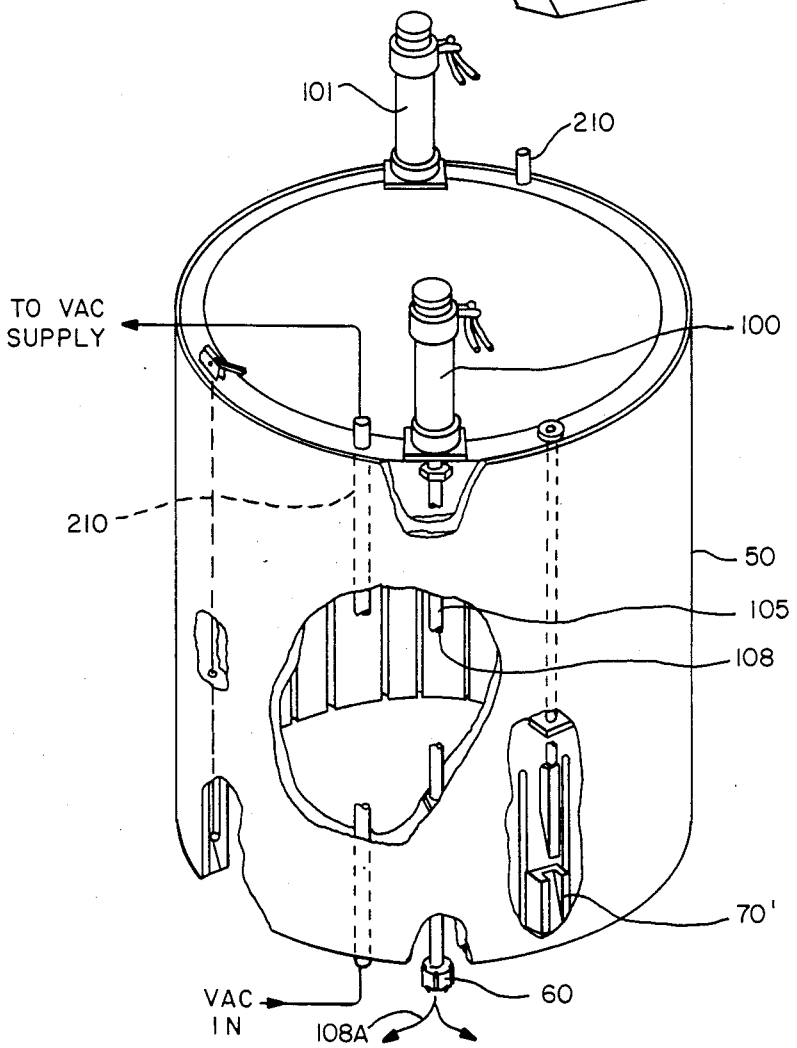

FIG. 6 presents a broken away perspective view of a coring sleeve which may form part of the overall apparatus shown in FIG. 2 and which highlights the parts that pass therethrough.

Figures 7, 8:
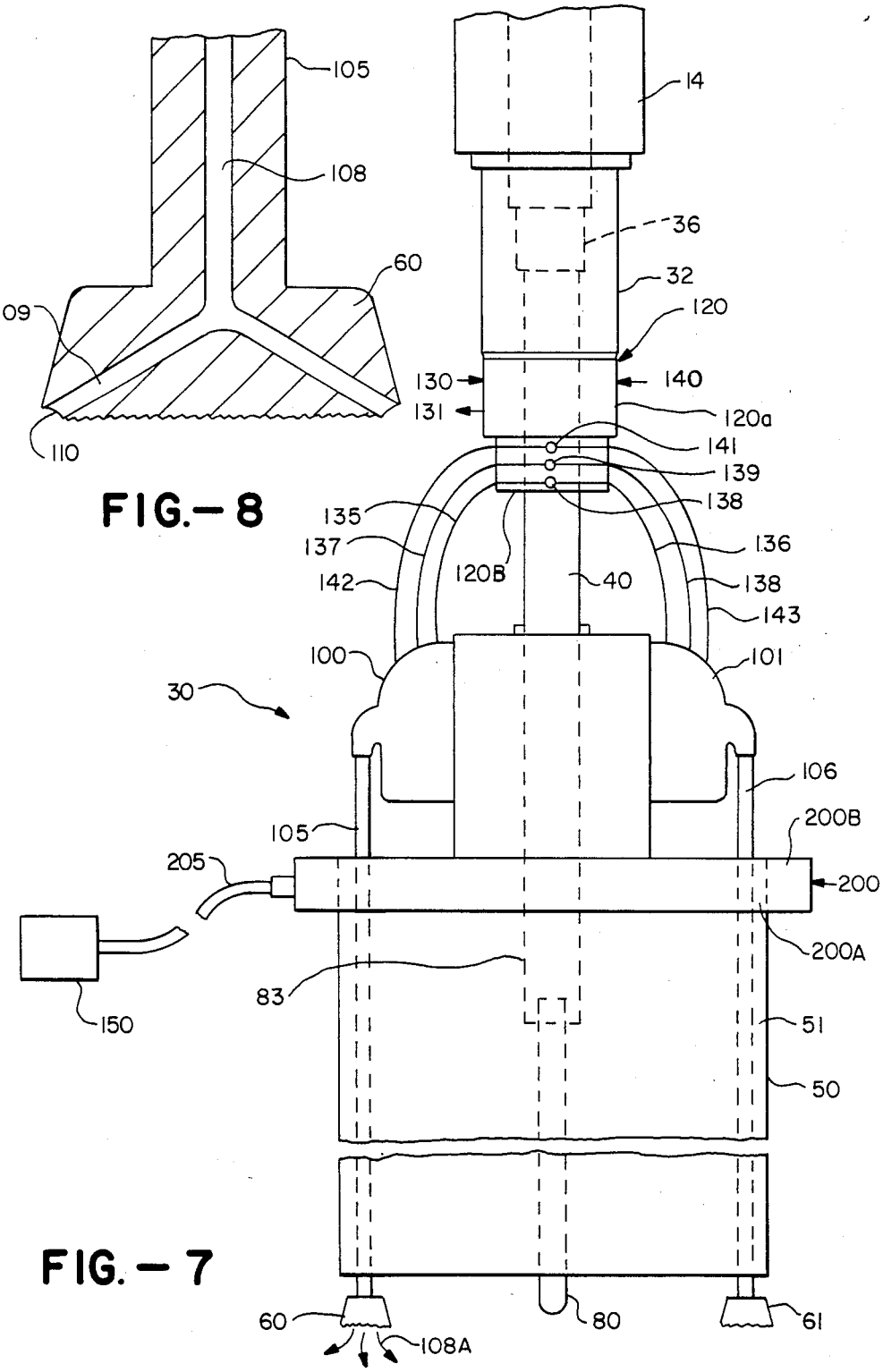

FIG. 7 is a schematic view of the percussive kerf vacuum apparatus of FIG. 2 highlighting the rotary union and the parts it is in direct communication with.

FIG. 8 shows a cross sectional view of the drill bit highlighting its interior passage.

Figure 9A:
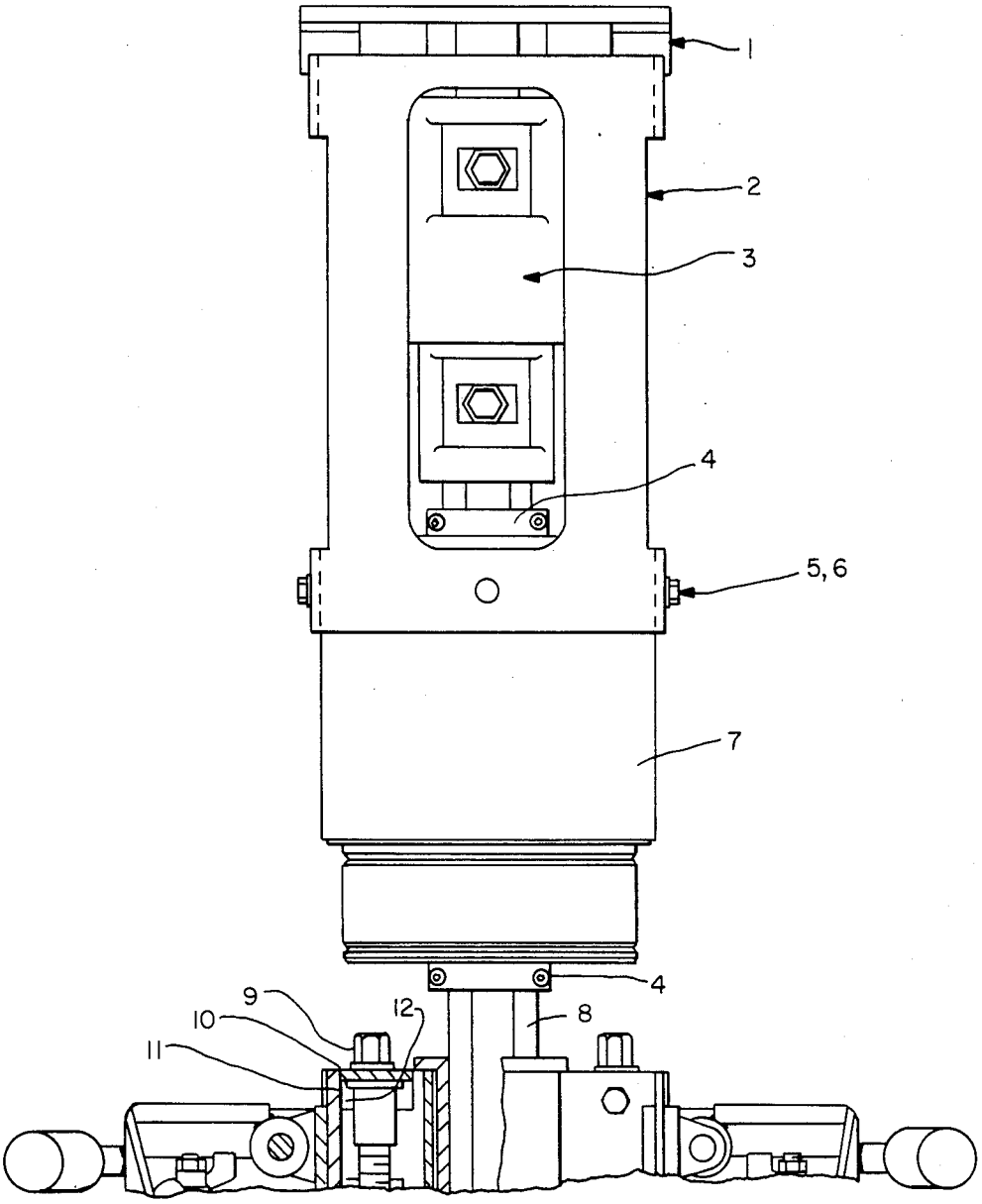
Figure 10:
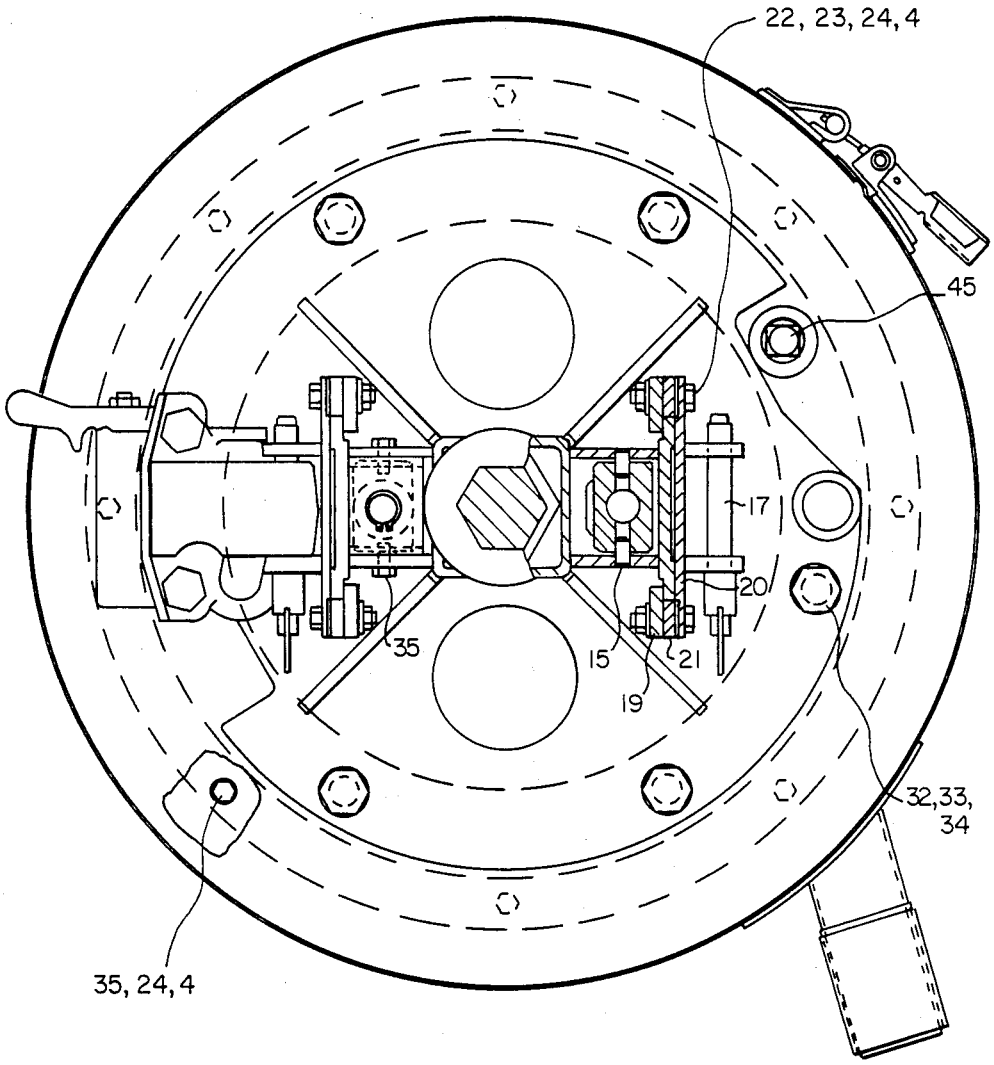

FIGS. 9A, B and C and FIG. 10 are illustrations in elevation and cross section of an actual working embodiments of an apparatus of the type shown in FIG. 2 with FIGS. 9A, B and C corresponding to top, intermediate and bottom sections of the apparatus.

Figure 1:
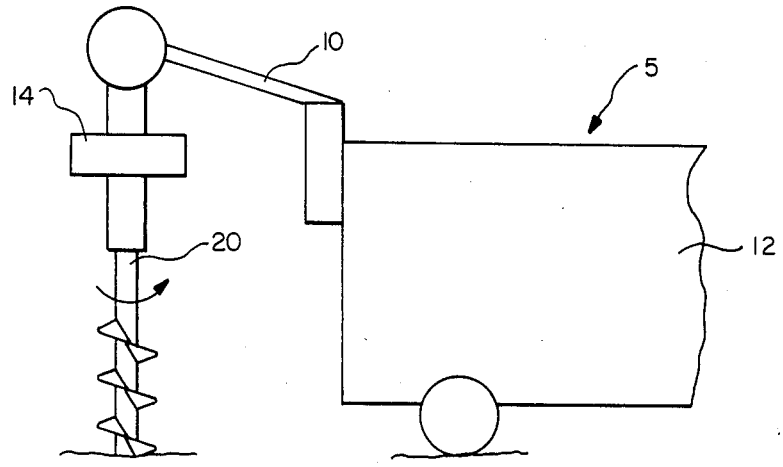
FIG. 1 is an elevational view of a conventional auger digger truck shown employing an auger.

Turning now to the drawings wherein like components are designated by like reference numerals throughout the various figures, attention is first directed to FIG. 1 which shows a conventional auger digger truck 5. Holes for receiving utility and telephone poles are typically dug by such a utility truck dedicated primarily for that task. Auger digger trucks employ a standard boom 10 rotatably mounted on one end to the back of its truck 12. A torque head 14 is both prismatically and rotationally connected to the free end of boom 10. This allows some flexibility in positioning a conventional auger 20 that is attached thereto over the location of the desired hole. The torque head 14 provides the rotary motion necessary to allow auger 20 to penetrate the earth. The present invention relates to an attachment to be used in place of the auger 20 when it is necessary to drill through rock or other hard materials.

Figure 3:
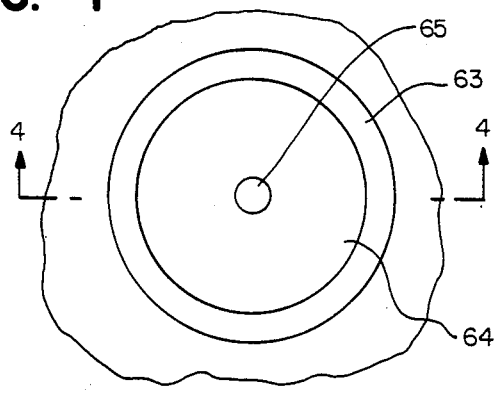
FIG. 3 is a perspective view showing what the top of a pole hole drilled in accordance with the method of the present invention would look like prior to pulling its core if the percussive kerf cutting apparatus were removed.
Figure 4:
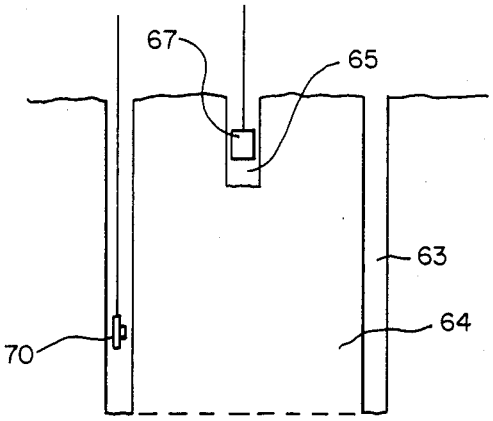
FIG. 4 is a side elevational cut along line 4—4 in FIG. 3 showing the same cuts.

Reference is now made to FIG. 2 which illustrates one embodiment of the present invention. Percussive kerf drilling assembly 30 is designed so it can be attached to torque head 14 in a manner similar to how a conventional auger would be attached. Adapter 32 located on the top end of the percussive kerf drilling assembly 30 accommodates this connection. Shaft 40 transmits the rotary motion generated by the torque head 14 to a coring sleeve 50. The coring sleeve 50 is essentially a thick walled hollow cylinder having diametrically opposite holes 55 extending axially its length for accommodating strike bars which will be discussed hereinafter and which carry at their respective ends two drill bits 60 and 62 located opposite of each other on its bottom surface. As will be seen hereinafter, each of the drill bits is subjected to (1) rotary motion (rotation about its own axis), (2) percussive motion, and (3) rotational movement (rotation about a spaced axis). When driven in this rotational rotary percussive manner contemplated by the present invention, the drill bits 60 and 61 cut a circular kerf 63 (see FIG. 3) through the rock they attack. It should be noted that the working edge of drill bits 60 and 61 are slightly wider than the width of the wall of coring sleeve 50. This allows the coring sleeve 50 to follow the drill bits 60 and 61 down the kerf as drilling takes place. The width of the drill bits, however, are small when compared to the diameter of the coring sleeve. FIGS. 3 and 4 illustrate what the kerf 63 looks like. The kerf 63 defines a rock core 64 that is to be broken off at its base and removed to allow the formation of a pole hole.

Figure 5:
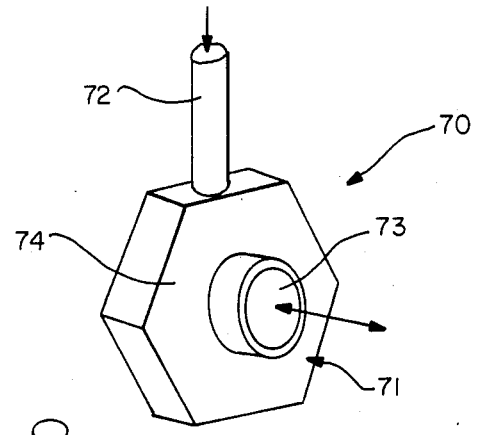
FIG. 5 is an enlarged perspective view of a hydraulic piston arrangement for breaking the core shown in FIG. 3.

The manner in which the rock core is broken is best illustrated by FIGS. 4 and 5. After the percussive kerf drilling apparatus 30 is withdrawn, a hydraulic piston arrangement 70 is inserted within a section of the kerf 63. This arrangement includes a cylinder section 71 shaped essentially as a disc and designed to be energized and de-energized hydraulically from a suitable hydraulic source (not shown) through conduit 72. A piston 73 is connected with the cylinder section for movement between a contracted position flush with one surface 74 of the cylinder section and an extended position projecting from surface 74 when the cylinder is in its de-energized and energized states, respectively. The piston 70 is positioned within the kerf in its de-energized condition and, then energized to cause piston 73 to expand outward causing the core 64 to crack at its base. Once the bottom of the core has been cracked, an expanding tool 67 (FIG. 4) which may be similar to arrangement 70 (or a different type of suitably providable tool) is inserted into pilot hole 65; expanded in order to hold onto the core; and lifted, thereby removing the core from the ground. The prior art teaches several alternative methods of breaking off a core of material and "catching" the core so it can be removed. See for example, U.S. Pat. No. 1,867,711 to WELLENSIER. It is contemplated that hydraulic piston arrangement 70 could be incorporated within the walls of coring sleeve 50, or a wedge shaped breaking shoe 70' could be so incorporated for the same purpose, as is illustrated in FIG. 6, although in a preferred embodiment a separate arrangement is used.

Now referring to FIGS. 4 and 7, it is generally desirable to drill a pilot hole 65 before beginning to drill the kerf. By so doing, the pilot hole which is contemplated to be drilled by hand, can serve two functions. As previously discussed, one function of the pilot hole is to facilitate removing the core after it has been severed from the surrounding ground. Additionally, when the pilot hole is utilized in conjunction with guide pin 80 forming part of the percussive kerf drilling assembly 30, it prevents the assembly from slipping while the kerf is being cut. Guide pin 80 extends from a telescopic kelly bar 83 attached to the center of coring sleeve 50. After pilot hole 65 has been cut, kerf drilling assembly 30 is positioned over the desired hole location and guide pin 80 is placed in the pilot hole. As the drilling assembly cuts its way through the rock, telescopic kelly bar 83 collapses, thereby eliminating the need to extend the pilot hole. Guide pin 80 and telescoping kelly bar 83 are attached so as to oppose lateral movement of the drilling assembly. This non-slip feature is particularly desirable when it is necessary to drill into rock located on an incline.

Referring now to FIG. 6 in conjunction with FIG. 7, drilling is accomplished by utilizing a pair of high frequency hydraulic rock drills 100 and 101 (generally referred to herein as percussive drills) that are independently connected to drill bits 60 and 61, respectively. These connections are made via strike bars 105 and 106 housed within axial passages 55 through the wall of coring sleeve 50. It is preferred that the strike bars be merely an extension of the percussive drill with which they are associated. The vibratory motion imparted by percussive drills 100 and 101 upon their respectively associated drill bits 60 and 61 are similar to the pounding motion common in jack hammers and other rock drills. At the same time, the drills impart rotary motion to each bit (thereby driving the bit in a "rotary/percussive manner) while both of the bits are rotationally moved about the axis of coring sleeve 50 as the latter is rotated. The percussive drills are preferably of a type capable of independently varying the rotary speed and frequency of percussion of the bit it drives. At the same time, the speed of rotation of the coring sleeve can be independently varied. As a result, three types of motion can be independently adjusted with respect to one another depending upon the type of rock or soil being drilled into so as to maximize the cutting efficiency.

When the assembly 30 is operational, it is contemplated that coring sleeve 50 will be rotated while percussive drills 100 and 101 are running, thus carrying drill bits 60 and 61 about the circumference of the kerf as each rotates about its own axis and moves in a percussive way. This "combined action" of the bits allows their working edges to be much smaller than would be necessary for a strictly percussive device designed to cut a hole of the same diameter. By reducing the area over which the bits impact against the rock, the stresses created in the rock will be concentrated, thereby making it easier to chip. Similarly, vibratory motions of the drill bits are desirable since the resultant pounding action also greatly increases the stress applied to the rock.

As illustrated best in FIG. 2, the percussive drills 100 and 101 are mounted above coring sleeve 50 but within its outermost diameter. In this way, the drills are located within the confines of kerf 63. As a result, it is possible to provide a hole deeper than the axial extent of sleeve 50. This is accomplished by removing core 64 (see FIG. 4) while it is no longer than the sleeve and then continuing downward with the sleeve carrying the rock drills with it. Each time the successively formed cores approach the length of the coring sleeve, they are removed, allowing the drills to go further into the hole.

Since percussive drills 100 and 101 are preferably standard hydraulic rock drills, it is necessary to supply them with oil. In accordance with the invention, the oil can be supplied through suitable lines from an external pump (not shown). Since the oil is supplied form an external source, these lines would quickly become entangled if they were subjected to the drilling assembly's rotation. Referring now to FIG. 7, introduction of oil to the percussive kerf drilling apparatus 30 is accommodated by rotary union 120 having an upper section **120*a* that is stationary and a lower section 120*b* that rotates along with shaft 40. The rotary union 120 which is a standard part is capable of channeling fluids between its stationary upper section 120*a* and its rotating lower section 120*b*. The rotary union is located directly below adapter 32. Attached to the stationary upper portion of the rotary union 120*a* are two fluid lines 130 and 131. Line 130 provides oil from the external pump (not shown) at high pressure. This oil passes through the rotary union 120 and out its lower section 120*b* at nozzle 132. Two rotating fluid lines 135 and 136 are connected to nozzle 132 and channel the oil to percussive drills 100 and 101, respectively. The oil is then used to drive the hydraulic percussive drills 100 and 101. The spent fluid is returned to the rotary union 120 through fluid lines 137 and 138 which flow into return nozzle 139 located on the rotary unions lower portion 120*b*. The spent oil passes through rotary union 120 and exits through line 131** which channels the oil to an external reservoir (not shown). The flow rate of the oil and its requisite pressure are entirely functions of the requirements of the specific hydraulic rock drills chosen.

Also inputted to the rotary union's upper sections **120*a* is air line 140 that feeds air to the percussive kerf drilling apparatus 30 from an external air compressor (not shown). This air serves two purposes, first it cools the drill bits and second it blows into the air surrounding the drill bits the dust and rock fragments that the bits generate. The air is channeled through the rotary union and out nozzle 141 which is attached to the rotary unions lower portion 120*b*. Air lines 142 and 143 are connected to percussive drills 100 and 101 respectively. Focusing now on percussive drill 100, (note that air passes through drill 101 in an identical fashion) air from line 142 enters the drill and is channeled into the small hole 108 that passes longitudinally through the center of strike bar 105 and out the bottom of the drill bit, as indicated by arrows 108*a* (see FIG. 6**).

Now referring to FIG. 8, longitudinal hole 108 meshes with an interior passage 109 within drill bit 60. By passing through the interior of the bit, the airstream cools the bit much more effectively than it could be merely passing over the bits exterior. Such cooling is desirable since it greatly enhances the useful life of the bit. The airstream then exits the bit through opening 110 which is located near the working surface of bit 60. The resulting jet of air that emerges from opening 110 strikes the working surface of the rock causing a great deal of turbulence in the vicinity of bit 60. The turbulence causes dust and particles of rock to be suspended in the air thus cleaning the working face of broken rock for efficient use of the bits. This dust laden air is then sucked out of the kerf drilling assembly 30 by vacuum source 150.

An external compressor (not shown) may be used to supply the air necessary to run the air flushing system just described. Appropriate air pressures delivered from the compressor are in the neighborhood of 70 to 120 pounds per square inch.

Attention is now directed to FIGS. 6 and 7 to facilitate explanation of the vacuum system. Swivel 200 is attached about the very top of coring sleeve 50. Swivel 200 has a rotating inner section **200*a* and a stationary outer section 200*b*. One end of vacuum hose 205 shown in FIG. 7 is coupled to the swivel's stationary section 200*b*, while its other end is connected to an external vacuum supply 150. The inner section 200*a* couples to a plurality of vacuum tubes 210 as seen in FIG. 6. Vacuum tubes 210 are housed within the walls of coring sleeve 50 and extend through the top of coring sleeve 50 so as to couple with swivel 200. The bottom ends of vacuum tubes 210 extend slightly below the bottom of the coring sleeve. It is desirable to have at least one vacuum tube associated with each drill bit positioned in front of the drill bit in its rotational sense. It should be noted, however that the present invention contemplates the use of multiple vacuum tubes spaced at various positions about the bottom of coring sleeve 50**. The vacuum system can thus suck the dust laden air from the vicinity of the drill bit, thereby removing the cuttings generated by the drilling action.

While the percussive kerf drilling assembly just described is preferred, it is to be understood that the present invention is not limited to the specific features described. For example, the present invention contemplates not only two but also a greater plurality of independently actuated percussive drill bits. Furthermore one of the plurality of hydraulic drills could be used to drive multiple drill bits. It is also contemplated that air could be supplied to the inner passages of the drill bits in a manner other than through the strike bars. For example they could be directed through the openings in the coring sleeve accommodating the strike bars without having to pass through passageways in the latter. Also, while the assembly has been described for drilling pole holes, it can be used to drill holes for other purposes. Moreover, while the drills have been described as being hydraulically driven, they could be driven pneumatically or possibly electrically.

As illustrated in FIG. 6, it is contemplated that hydraulic core breaking piston 70' could be incorporated within the walls of coring sleeve 50. Similarly, a core "catching" device could be incorporated within the walls of the coring sleeve. Additionally, it may be desirable to rotate the kerf drilling assembly at an angular velocity slower than that of the torque head. This can be accommodated by installing a speed reducer 35 positioned between rotary union 120 and adapter 32.

Figure 9B:
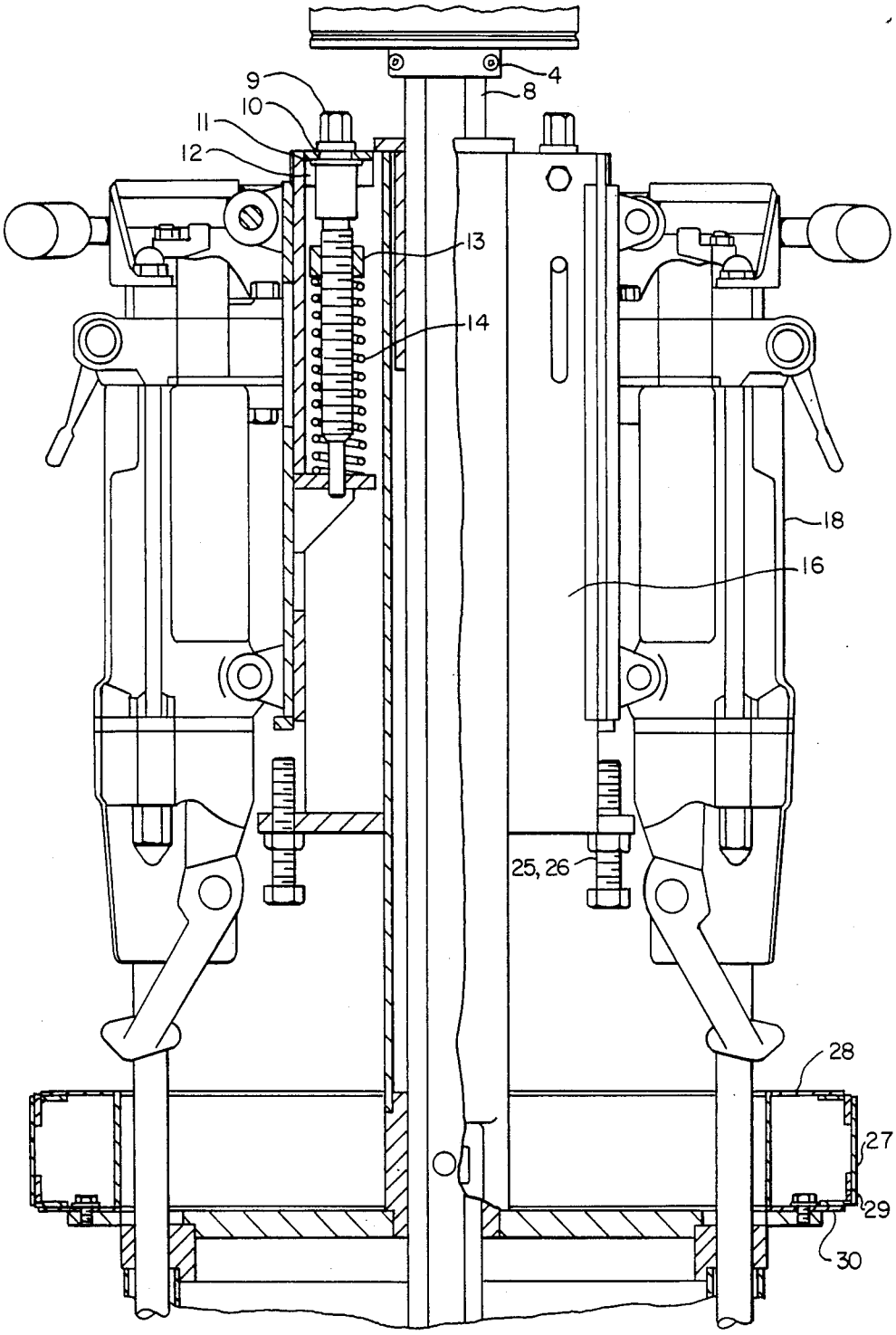
Figure 9C:
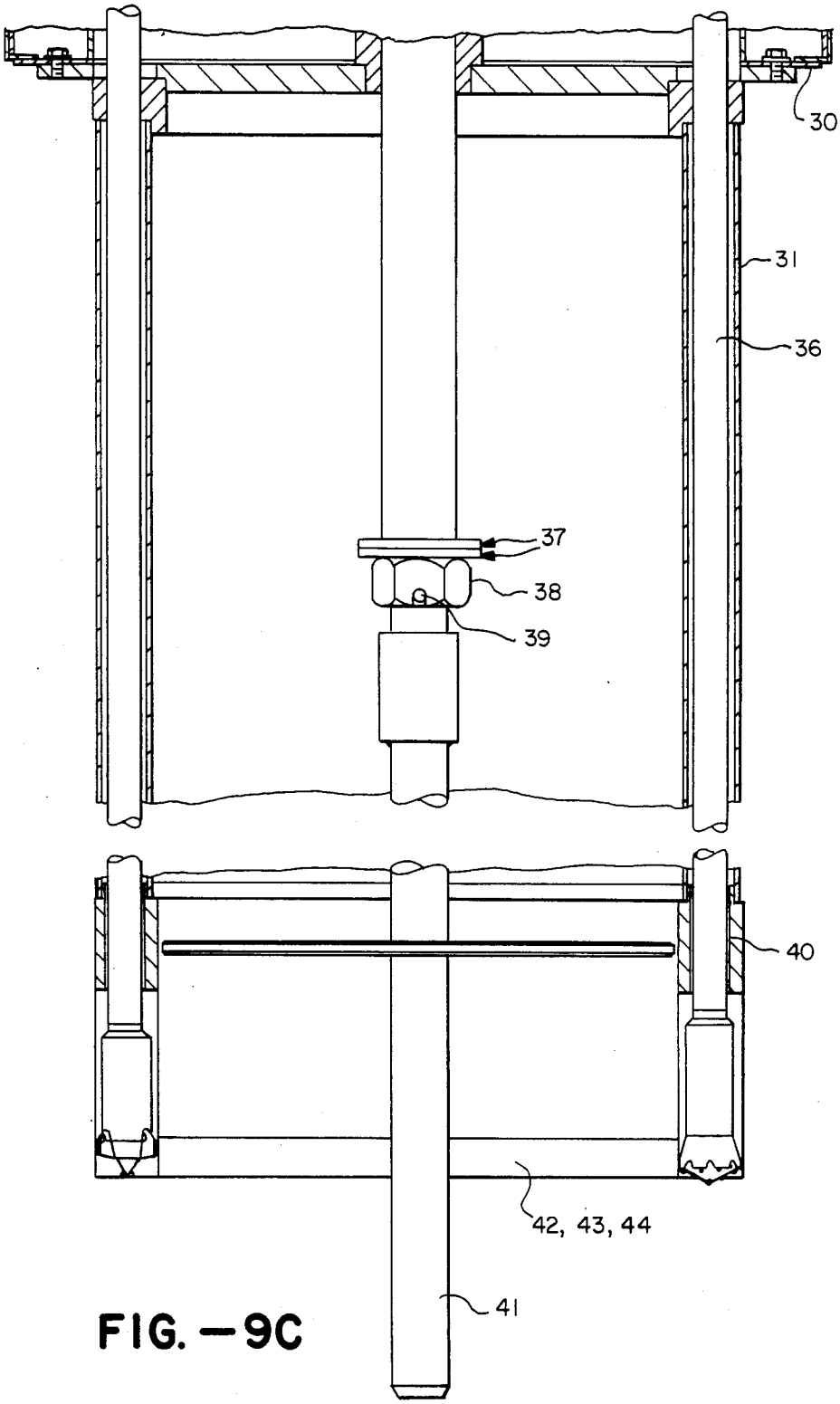

Turning now to FIGS. 9 and 10, these figures illustrate, in part, an actual working embodiment of a percussive kerf drilling assembly designed in accordance with the present invention. The various components referred to by number in these two figures are listed in Table I below. It is to be understood that the present invention is not limited to this particular embodiment.

TABLE I

| Item | Part Number | Description | Vendor |
|---|---|---|---|
| 1 | 010024 | Key, cage | |
| 2 | 010023 | Cage | |
| 3 | 010010 | Reducer Coupling | |
| 4 | 250200 | Clamping Collar | Boston gear |
| 5 | | ⅜-16-¾ lg. Hex hd. cap scr | Elec. Fast. |
| 6 | | ⅜ lock washer | Elec. Fast. |
| 7 | 700-092-01 | Rotary Union | Scott Eng. |
| 8 | 010011 | Kelly Bar | |
| 9 | 010008 | Screw, adjusting | |
| 10 | 5100-87 | Retaining Ring | Truarc |
| 11 | TT-1503 | Thrust Washer | Oilite |
| 12 | 010007 | Plate Retainer | |
| 13 | 010006 | Nut, spring adj. | |
| 14 | 010005 | Spring, adj. | |
| 15 | | Dowel Pin ⅜ d. × 1" lg | |
| 16 | 010001 | Drill Tower | |
| 17 | CL-10-BLP-3-5 | Ball Lock Pin | Carr Lane |
| 18 | HE-50-F | Drill, Hydraulic | Tamrock |
| 19 | 010004 | Guide, Slide Plate | |
| 20 | 010002 | Slide Plate | |
| 21 | 010003 | Spacer, slide plate | |
| 22 | | ⅜-16 × 1½ lg. Hex Hd. cap scr. | Elec. Fast. |
| 23 | | ⅜-16 Hex nut | Elec. Fast. |
| 24 | | ⅜ washer | Elec. Fast. |

TABLE I-continued

| Item | Part Number | Description | Vendor |
|---|---|---|---|
| 25 | | ¾-10 × 3½ lg. Hex hd. cap scr. | Elec. Fast. |
| 26 | | ¾-10 Jam nut | Elec. Fast. |
| 27 | 010015 | Muck swivel, cover | |
| 28 | 010013 | Muck Swivel, housing | |
| 29 | 010016 | Bearing Strip | |
| 30 | 010014 | Bearing, Pad | |
| 31 | 010017 | Core Barrel | |
| 32 | | ¾-10 × 1½ lg. hex hd. cap scr. | Elec. Fast. |
| 33 | | ¾ lock washer | Elec. Fast. |
| 34 | | ¾ washer | Elec. Fast. |
| 35 | | ⅜-16 × ¾ lg hex hd cap scr. | Elec Fast. |
| 36 | 010027 | Drill Steel (round) | |
| 37 | | 1½ series "r" Washer (¼ thk) | Elec. Fast. |
| 38 | | 1½ hex slotted nut | Elec. Fast. |
| 39 | | ⅜ × 3" lg cotter pin | Elec. Fast. |
| 40 | 16DU24 | Garlock Du Bearing | Bearings, Inc |
| 41 | 010021 | Guide, core barrel | |
| 42 | 010020 | Wear Show | |
| 43 | | V2-12 × 1: "lg FHMS | Elec. Fast. |
| 44 | | ½-13 × 1" lg. Hex Hd. cap scr. | Elec. Fast. |
| 45 | | 1-11½ NPT Pipe plug | |

What is claimed is:

1. A method of digging a vertically downward hole through the above ground surface of hard material, especially where the above ground surface is at an incline, utilizing a drilling apparatus including a coring sleeve having a bottom end and a longitudinal axis, a first drill bit and a second drill bit, said drill bits extending through the wall of said coring sleeve so as to be positioned at the bottom of the latter, said method comprising the steps of:

(a) independently driving said first and second drill bits in a rotary/percussive manner while rotating said coring sleeve in one direction 360° about its longitudinal axis in order to cause said drilling apparatus to move axially downward and cut a deep kerf, whereby to define a core of material to be removed, the core having a base end;

(b) providing said drilling apparatus with a centering pin assembly including a centering pin located along the longitudinal axis of said coring sleeve and pin connecting means connected with said sleeve for axial downward movement with the sleeve, said pin connecting means supporting said pin in its longitudinal position along the axis of said sleeve but movable axially relative to said pin along with said sleeve, whereby said pin connecting means moves downward with said sleeve relative to said pin;

(c) prior to cutting said kerf, drilling a vertically extending pilot hole into said hard material from its above ground surface;

(d) inserting said centering pin into said pilot hole for preventing said drilling apparatus from slipping laterally while said kerf is being cut, and causing said coring sleeve and pin connecting means to move downward to a limited extent relative to said centering pin while the latter remains stationary as said kerf is being cut;

(e) after said kerf has been cut, breaking the core of material defined by said kerf at its base end; and (f) removing said core of material.

2. A method according to claim 1 including only two drill bits.

3. An apparatus for digging a vertically downward hole through the above ground surface of hard material, especially where the above ground surface is at an incline, comprising:

(a) a coring sleeve having a bottom end and a longitudinal axis;

(b) first and second drill bits extending through the wall of said coring sleeve so as to be positioned at the bottom of the latter;

(c) means for independently driving said drill bits in a rotary/percussive manner while rotating said coring sleeve in one direction 360° about its longitudinal axis in order to cause said coring sleeve to move axially downward and cut a deep kerf whereby to define a core of material to be removed, the core having a base end;

(d) a centering pin assembly including a centering pin located along the longitudinal axis of said coring sleeve and pin connecting means connected with said sleeve for axial downward movement with said sleeve, said pin connecting means supporting said pin in its longitudinal position along the axis of said sleeve but movable axially relative to said pin, whereby said pin connecting means moves downward with said sleeve relative to said pin when said pin is inserted into a preprepared pilot hole and as the coring sleeve moves axially downward to cut said deep kerf;

(e) means for breaking the core of material defined by said kerf at its base end; and (f) means for removing said core material.

4. An apparatus according to claim 3 including only two drill bits.

* * * * *